US006267174B1

(12) United States Patent
Ozaki et al.

(10) Patent No.: US 6,267,174 B1
(45) Date of Patent: Jul. 31, 2001

(54) DOUBLE HEAT EXCHANGER HAVING CONDENSER AND RADIATOR

(75) Inventors: Tatsuo Ozaki, Okazaki; Norihisa Sasano, Ama-gun; Takaaki Sakane, Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/558,583

(22) Filed: Apr. 26, 2000

(30) Foreign Application Priority Data

Apr. 27, 1999 (JP) ..... 11-120372
Feb. 25, 2000 (JP) ..... 12-054426

(51) Int. Cl.[7] ..... F28F 9/04
(52) U.S. Cl. ..... 165/140; 165/135
(58) Field of Search ..... 165/76, 135, 140, 165/173

(56) References Cited

U.S. PATENT DOCUMENTS 5,033,540 * 7/1991 Tategami et al. ..... 165/135
5,186,243 * 2/1993 Halstead ..... 165/135
5,657,817 * 8/1997 Heine et al. ..... 165/67
6,012,512 * 1/2000 Ghiani ..... 165/140

FOREIGN PATENT DOCUMENTS

2113819 * 8/1983 (GB) ..... 165/140
1-247990 A1 * 10/1989 (JP) ..... 165/140
8-86588 4/1996 (JP) .
9-273889 10/1997 (JP) .
10-103893 4/1998 (JP) .

* cited by examiner

*Primary Examiner*—Allen Flanigan
(74) *Attorney, Agent, or Firm*—Harness, Dickey & Pierce, PLC

(57) ABSTRACT

A double heat exchanger has a condenser having a condenser tank and a condenser tank cap for closing an open end of the condenser tank, and a radiator having a radiator tank and a radiator tank cap for closing an open end of the radiator tank. The condenser tank cap has a protrusion which protrudes toward the radiator tank and contacts the radiator tank to form a gap between the condenser tank and the radiator tank. The protrusion is also used to clamp the condenser tank cap to the condenser tank. As a result, the gap is securely formed between the condenser tank and the radiator tank, while heat is transferred from the radiator tank to the condenser tank only through the protrusion. Therefore, heat transfer from the radiator tank to the condenser tank is sufficiently restricted without increasing a manufacturing cost.

8 Claims, 5 Drawing Sheets

DOUBLE HEAT EXCHANGER HAVING CONDENSER AND RADIATOR

CROSS REFERENCE TO RELATED APPLICATIONS

This application relates to and claims priority from Japanese Patent Application Nos. 11-120372 filed on Apr. 27, 1999 and 2000-54426 filed on Feb. 25, 2000.

BACKGROUND OF THE INVENTION

1. Field of the Invention

The present invention relates generally to heat exchangers, and particularly to a double heat exchanger having plural heat-exchange cores such as a condenser core of a refrigeration cycle and a radiator core for cooling engine coolant.

2. Related Art

JP-A-10-103893 discloses a double heat exchanger having a radiator and a condenser. A header tank of the radiator has plural protrusions each of which protrudes from an outer wall of a header tank of the radiator and contact an outer wall of a header tank of the condenser so that a gap is securely formed between the header tank of the condenser and the header tank of the radiator. As a result, heat transfer from the header tank of the radiator having a high temperature to the header tank of the condenser having a low temperature is restricted.

However, in the above-mentioned double heat exchanger, when the protrusions are brazed to the header tank of the condenser, melted brazing material flows to be collected at a contact portion between each of the protrusions and the header tank of the condenser by capillary action. Therefore, when a brazing process of the protrusions is completed, a size of each of the protrusions may be increased by the brazing material collected at the contact portion. As a result, an area of the contact portion through which heat is transferred from the header tank of the radiator to the header tank of the condenser is increased. Therefore, an amount of heat transferred from a core portion of the radiator to a core portion of the condenser may be increased, and a heat radiation performance of the core portion of the condenser may be declined.

Further, in the above-mentioned double heat exchanger, the protrusions are formed on the header tank of the radiator to be away from each other with an interval in a longitudinal direction of the header tank of the radiator. Therefore, when the header tank of the radiator is formed by extrusion or drawing to have an uniform cross-section along a whole length of the header tank of the radiator in the longitudinal direction thereof, it may be difficult to integrally form the protrusions with the header tank of the radiator.

SUMMARY OF THE INVENTION

In view of the foregoing problems, it is an object of the present invention to provide a heat exchanger having a plurality of heat-exchange core portions, which restricts a heat radiation performance of each of the heat-exchange core portions from declining.

According to the present invention, a heat exchanger through which air passes has a first core portion and a second core portion. The first core portion has a plurality of first tubes through which a first fluid flows and performs a heat exchange between the first fluid and air. The second core portion is arranged in line with the first core portion in an air-flow direction. The second core portion has a plurality of second tubes through which a second fluid flows and performs a heat exchange between the second fluid and air. A first tank is disposed at a flow-path end of the first tubes to extend in a direction perpendicular to a longitudinal direction of the first tubes and to communicate with the first tubes. A second tank is disposed at a flow-path end of the second tubes to extend in a direction perpendicular to a longitudinal direction of the second tubes and to communicate with the second tubes. An open end of the first tank in the direction perpendicular to the longitudinal direction of the first tubes is closed by a first tank cap. The first tank cap has a protrusion protruding from the first tank cap toward the second tank and contacting the second tank to form a gap between the first tank and the second tank.

As a result, the gap is securely formed between the first tank and the second tank by the protrusion, and heat is transferred from the first tank to the second tank only through the protrusion. Therefore, heat is sufficiently restricted from being transferred from the first tank to the second tank, and a heat radiation performance of each of the first and second core portions is restricted from declining. Further, since the protrusion protrudes not from an outer wall of the first or second tank but from the first tank cap, the first tank is readily integrally formed by extrusion or drawing. Therefore, a mechanical strength of the first tank is increased and a manufacturing cost of the first tank is decreased.

Preferably, the first tank cap is clamped to the first tank by the protrusion. As a result, the protrusion is used as a clamping member for clamping the first tank cap to the first tank, and a manufacturing cost of the first tank is not increased.

BRIEF DESCRIPTION OF THE DRAWINGS

This and other objects and features of the present invention will become more readily apparent from a better understanding of the preferred embodiments described below with reference to the accompanying drawings, in which.

DETAILED DESCRIPTION OF THE PREFERRED EMBODIMENT

A preferred embodiment of the present invention is described hereinafter with reference to the accompanying drawings. In the embodiment, the present invention is applied to a double heat exchanger having a condenser core 110 of a condenser 100 of a refrigeration cycle for a vehicle air conditioner as a first core portion, and a radiator core 210 of a radiator 200 to cool engine coolant for a vehicle engine as a second core portion. The radiator 200 is disposed at a downstream air side of the condenser 100 with respect to air passing through the double heat exchanger.

Figure 1:
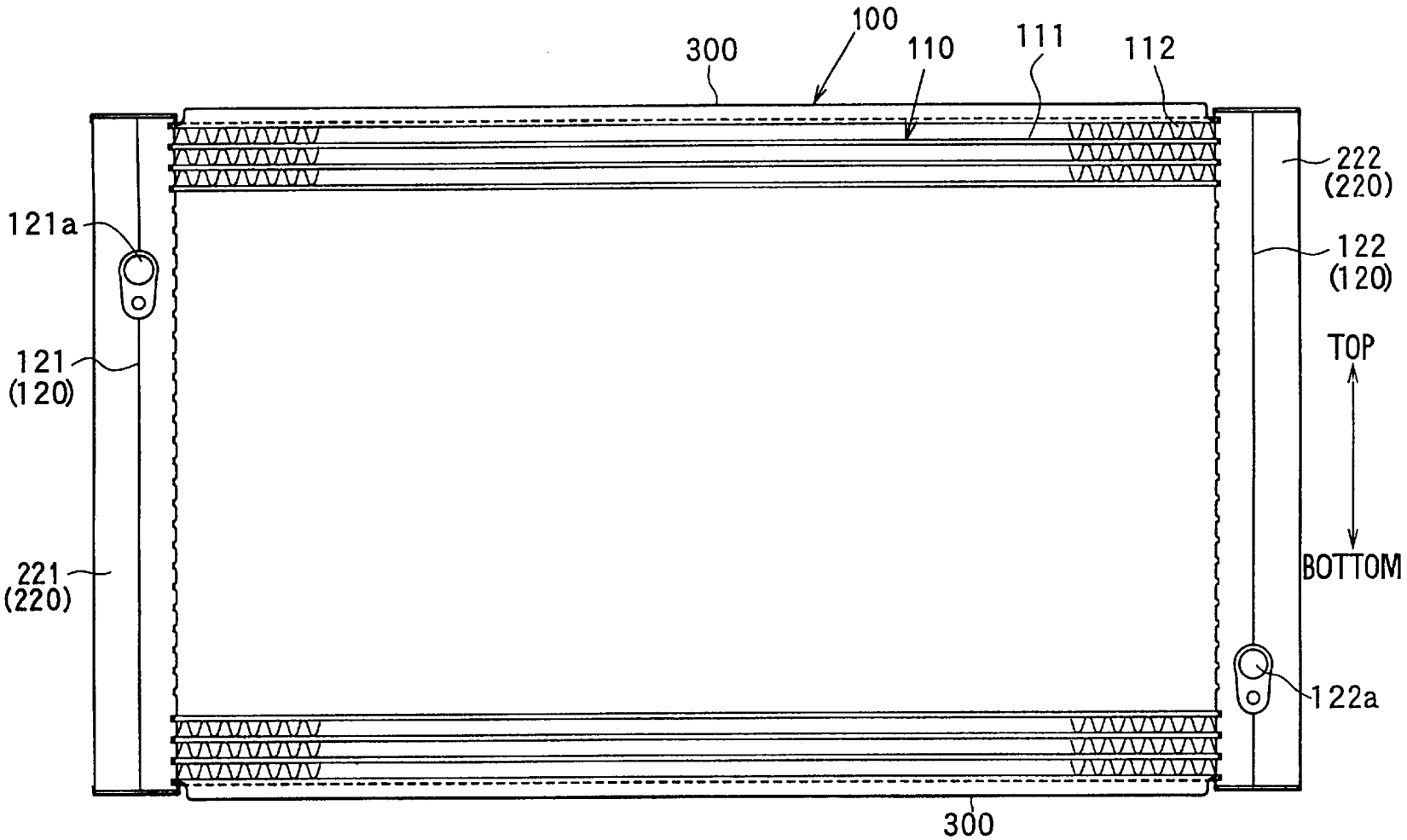
FIG. 1 is a front view showing a condenser of a double heat exchanger according to a first preferred embodiment of the present invention.

As shown in FIG. 1, the condenser 100 of the double heat exchanger has plural flat condenser tubes 111 through which refrigerant flows and plural corrugated condenser fins 112. Each of the condenser fins 112 is disposed between adjacent condenser tubes 111 for facilitating heat exchange of refrigerant. Each of the condenser fins 12 is brazed to the condenser tubes 111 by brazing material clad on a surface of each of the condenser tubes 111. The condenser tubes 111 and the condenser fins 112 form the core portion 110 of the condenser 100 which cools and condenses refrigerant. In FIG. 1, the double heat exchanger is viewed from an upstream air side with respect to air passing through the double heat exchanger.

A first condenser tank 121 is disposed at one flow-path end (i.e., left end in FIG. 1) of the condenser tubes 111 to extend in a direction perpendicular to a longitudinal direction of the condenser tubes 111 and to communicate with the condenser tubes 111. The first condenser tank 121 has a connector 121*a* connected to an outlet of a compressor (not shown). Refrigerant discharged from the compressor is introduced into the first condenser tank 121 through the connector 121*a*, and is distributed into each of the condenser tubes 111.

A second condenser tank 122 is disposed at the other flow-path end (i.e., right end in FIG. 1) of the condenser tubes 111 to extend in a direction perpendicular to the longitudinal direction of the condenser tubes 111 and to communicate with the condenser tubes 111. The second condenser tank 121 has a connector 122*a* connected to an inlet of a decompressor (not shown). Refrigerant flowing through each of the condenser tubes 111 is collected into the second condenser tank 122 and is discharged toward the decompressor. Hereinafter, each of the first and second condenser tanks 121, 122 is referred to as a condenser tank 120.

Figure 2:
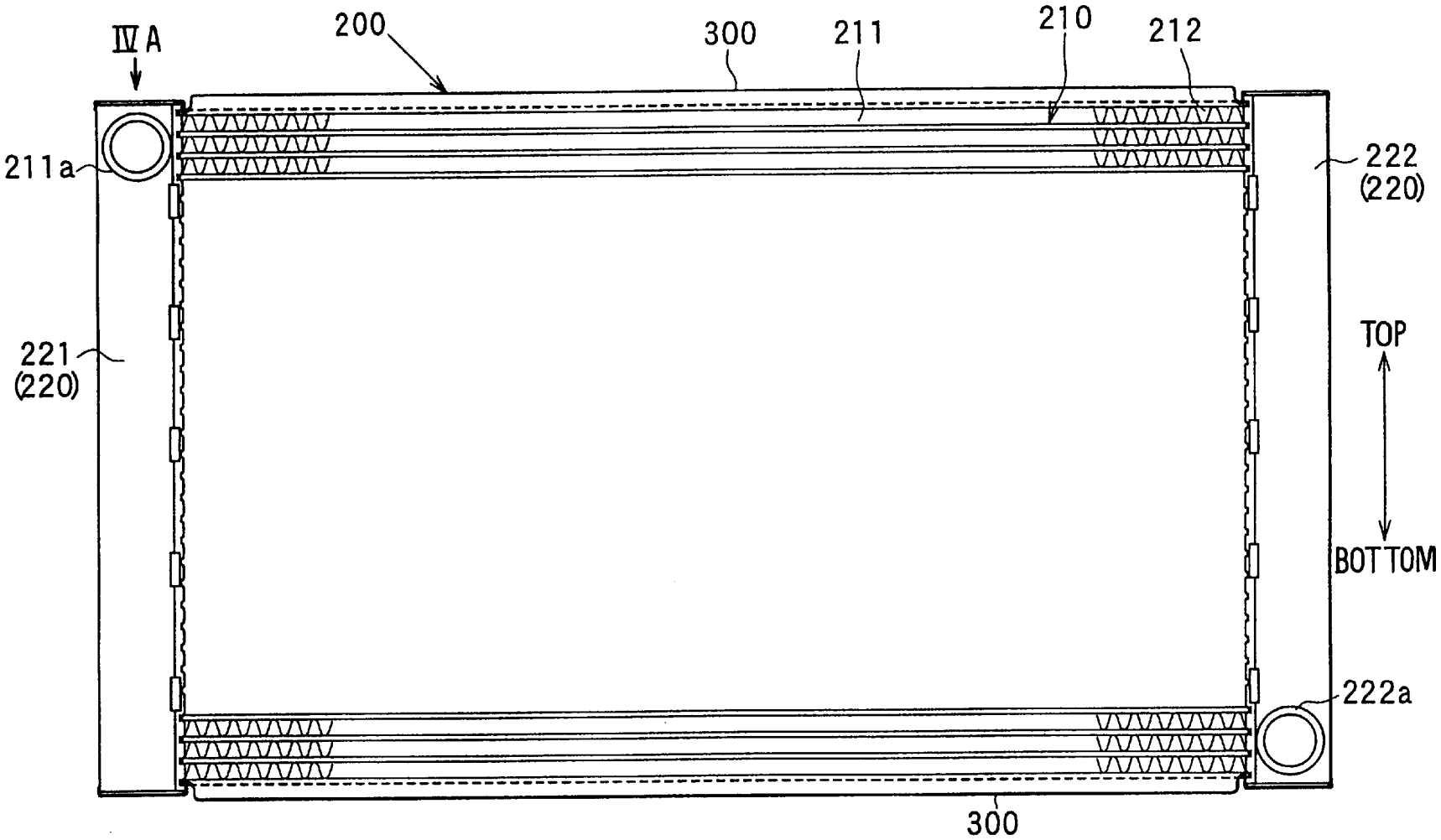
FIG. 2 is a front view showing a radiator of the double heat exchanger according to the first embodiment.

As shown in FIG. 2, the radiator 200 of the double heat exchanger has plural flat radiator tubes 211 through which engine coolant flows and plural corrugated radiator fins 212. Each of the radiator fins 212 is disposed between adjacent radiator tubes 211 for facilitating heat exchange of engine coolant. In FIG. 2, the double heat exchanger is viewed from a downstream air side with respect to air passing through the double heat exchanger.

Figure 3:
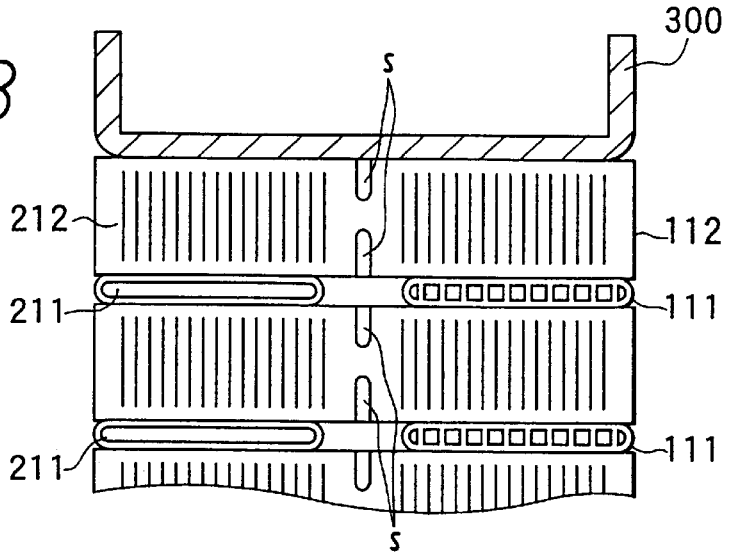
FIG. 3 is a sectional view showing a core portion of the double heat exchanger according to the first embodiment.

As shown in FIG. 3, each of the radiator fins 212 is integrally formed with each of the condenser fins 112. A slit "s" is formed between each of the radiator fins 112 and each of the condenser fins 212 to restrict heat transfer from the radiator fins 112 to the condenser fins 212. Each of the radiator fins 212 is brazed to the radiator tubes 211 by brazing material clad on a surface of each of the radiator tubes 211. The radiator tubes 211 and the radiator fins 212 form the core portion 210 of the radiator 200 which cools engine coolant.

Referring back to FIG. 2, the radiator 200 has a first radiator tank 221 disposed at one flow-path end (i.e., left end in FIG. 2) of the radiator tubes 211 to extend in a direction perpendicular to a longitudinal direction of the radiator tubes 211 and to communicate with the radiator tubes 211. The first radiator tank 221 has a connection pipe 221*a* connected to a coolant outlet of the engine. Coolant discharged from the engine is introduced into the first radiator tank 221 through the connection pipe 221*a*, and is distributed to each of the radiator tubes 211.

A second radiator tank 222 is disposed at the other flow-path end (i.e., right end in FIG. 2) of the radiator tubes 211 to extend in a direction perpendicular to the longitudinal direction of the radiator tubes 211 and to communicate with the radiator tubes 211. The second radiator tank 222 has a connection pipe 222*a* connected to a coolant inlet of the engine. Coolant flowing through each of the radiator tubes 211 is collected into the second radiator tank 222 and is discharged toward the engine. Hereinafter, each of the first and second radiator tanks 221, 222 is referred to as a radiator tank 220. In the embodiment, the condenser tank 120 is integrally formed by extrusion or drawing. The radiator tank 220 is formed by brazing two members each of which is formed by pressing to have a L-shaped cross-section.

Figure 4A:
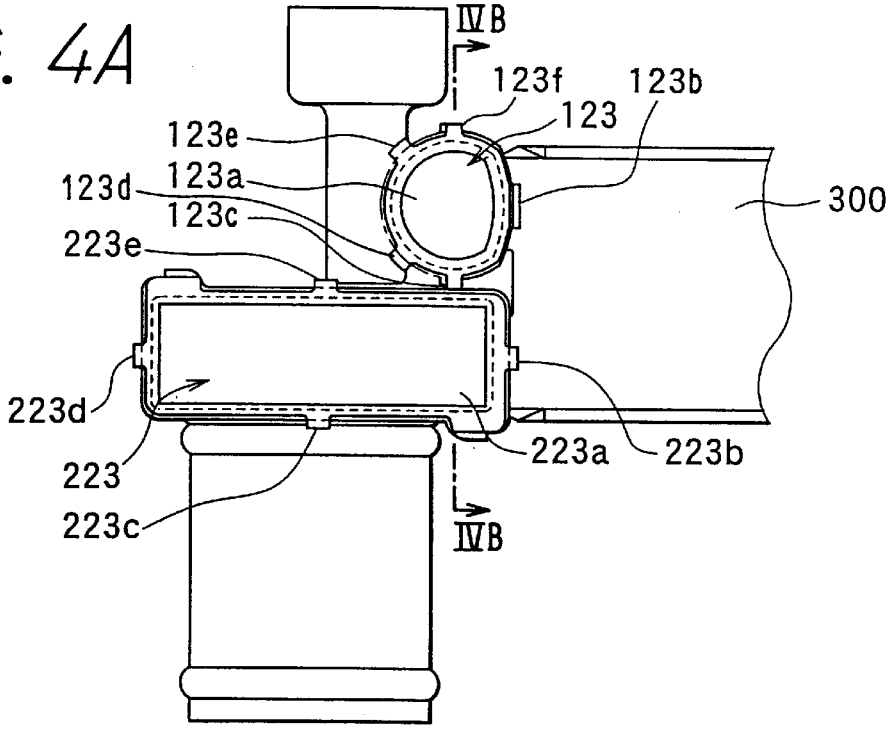
FIG. 4A is a top view taken from an arrow IVA in FIG. 2.

As shown in FIGS. 1, 2 and 4A, each of ends of the condenser tank 120 in a direction perpendicular to the longitudinal direction of the condenser tubes 111, that is, each of upper and lower ends of the condenser tank 120 in FIG. 1, is closed by a condenser tank cap 123. Similarly, each of ends of the radiator tank 220 in a direction perpendicular to the longitudinal direction of the radiator tubes 211, that is, each of upper and lower ends of the radiator tank 220 in FIG. 2, is closed by a radiator tank cap 223. The condenser tank cap 123 is brazed to the condenser tank 120 by a brazing material clad on an outer wall of the condenser tank 120 and a brazing material clad on an inner wall of the condenser tank cap 123. The radiator tank cap 223 is brazed to the radiator tank 220 by a brazing material clad on an outer wall of the radiator tank 220 and a brazing material clad on an inner wall of the radiator tank cap 223.

The condenser tank cap 123 is formed by pressing an aluminum plate and has a cap body 123*a* and five protrusions 123*b*, 123*c*, 123*d*, 123*e* and 123*f* protruding from the cap body 123*a* substantially radially. The cap body 123*a* is formed into a disk-shape having a step portion along a periphery thereof, and closes an opening 120*a* formed at each of the upper and lower ends of the condenser tank 120. The condenser tank cap 123 is clamped to each of the upper and lower ends of the condenser tank 120 by the protrusions 123*b*–123*f*.

Figure 4B:
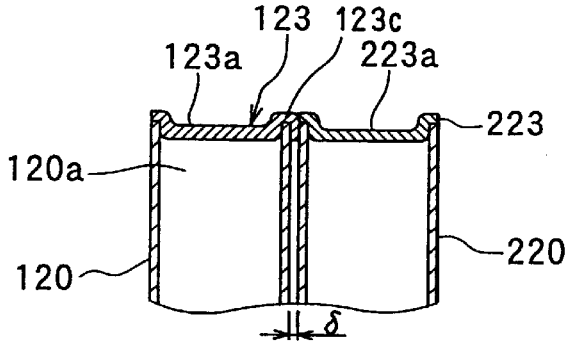
FIG. 4B is a sectional view taken along a line IVB—IVB in FIG. 4A.

As shown in FIG. 4A, the protrusion 123*c* is disposed proximate the radiator tank 220 and protrudes toward the radiator tank cap 223. As shown in FIG. 4B, the protrusion 123*c* contacts an outer wall of the radiator tank 220 while each of the upper and lower ends of the condenser tank 120 and the cap body 123*a* are clamped by the protrusions 123*b*–123*f*. As a result, a gap δ is formed between the condenser tank 120 and the radiator tank 220.

As shown in FIG. 4A, the radiator tank cap 223 also has a cap body 223*a* and four protrusions 223*b*, 223*c*, 223*d* and 223*e* protruding outwardly from the cap body 223*a*. The radiator tank cap 223 is clamped to the radiator tank 220 by the protrusions 223*b*–223*e*. After the condenser and radiator tank caps 123, 223 are tentatively clamped to the condenser and radiator tanks 120, 220, the condenser and radiator tank caps 123, 223 are brazed to the condenser and radiator tanks 120, 220, respectively.

According to the embodiment, the gap δ is securely formed between the condenser tank 120 and the radiator tank 220 by the protrusion 123*c* which protrudes from the condenser tank cap 123 and contacts the radiator tank 220.

As a result, heat is transferred from the radiator tank 220 to the condenser tank 120 only through a contact portion between the protrusion 123*c* and the radiator tank 220, which has a relatively small area. Therefore, even when melted brazing material is collected to the contact portion by capillary action to increase an area of the contact portion, the increase in the area of the contact portion is sufficiently small. Therefore, heat transfer from the radiator tank 120 to the condenser tank 220 is sufficiently restricted, and each heat radiation performance of the condenser core 110 and the radiator core 210 is restricted from declining.

Further, since the protrusion 123*c* is formed on the condenser tank cap 123, the gap δ is formed between the condenser and radiator tanks 120, 220 without forming any protrusion on an outer wall of the condenser tank 120 or the radiator tank 220. Therefore, the condenser tank 120 is readily integrally formed by extrusion or drawing, thereby increasing a mechanical strength thereof and reducing a manufacturing cost thereof. Further, in the embodiment, the protrusion 123*c* also functions as a clamping member for clamping the condenser tank cap 123 to the condenser tank 120. Therefore, the protrusion 123*c* can be formed using a conventional clamping member for clamping the condenser tank cap 123 to the condenser tank 120. As a result, a manufacturing cost of the condenser 100 is not increased.

Figure 5:
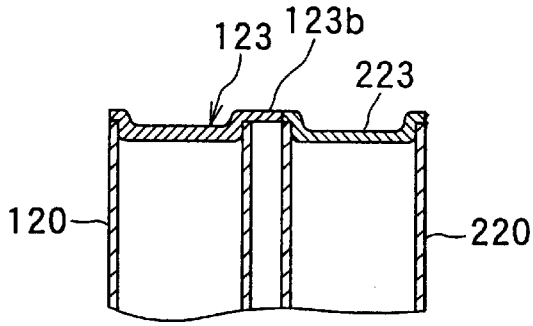
FIG. 5 is a sectional view showing a tank portion of a double heat exchanger according to a modification of the first embodiment.
Figure 6:
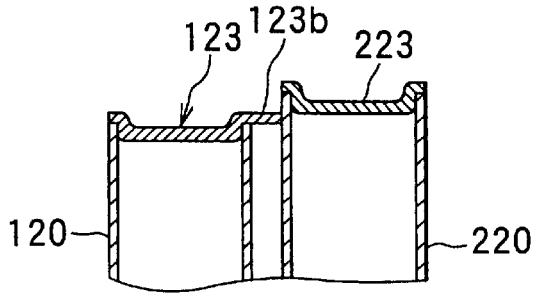
FIG. 6 is a sectional view showing a tank portion of a double heat exchanger according to a modification of the first embodiment.
Figure 7:
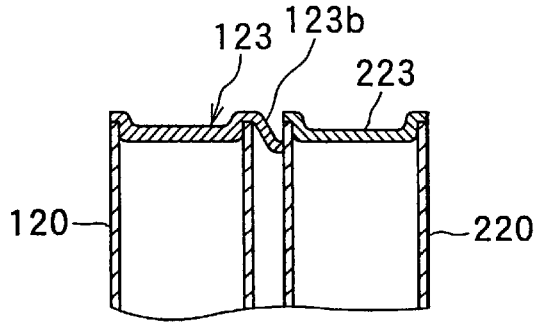
FIG. 7 is a sectional view showing a tank portion of a double heat exchanger according to a modification of the first embodiment.
Figure 8:
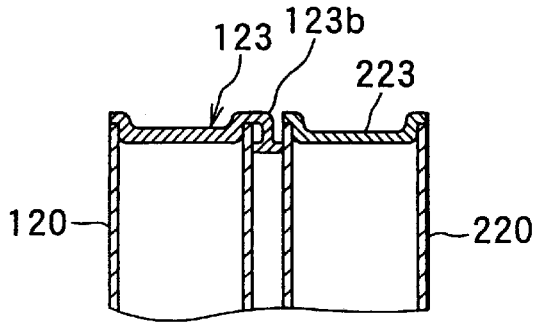
FIG. 8 is a sectional view showing a tank portion of a double heat exchanger according to a modification of the first embodiment.
Figure 9:
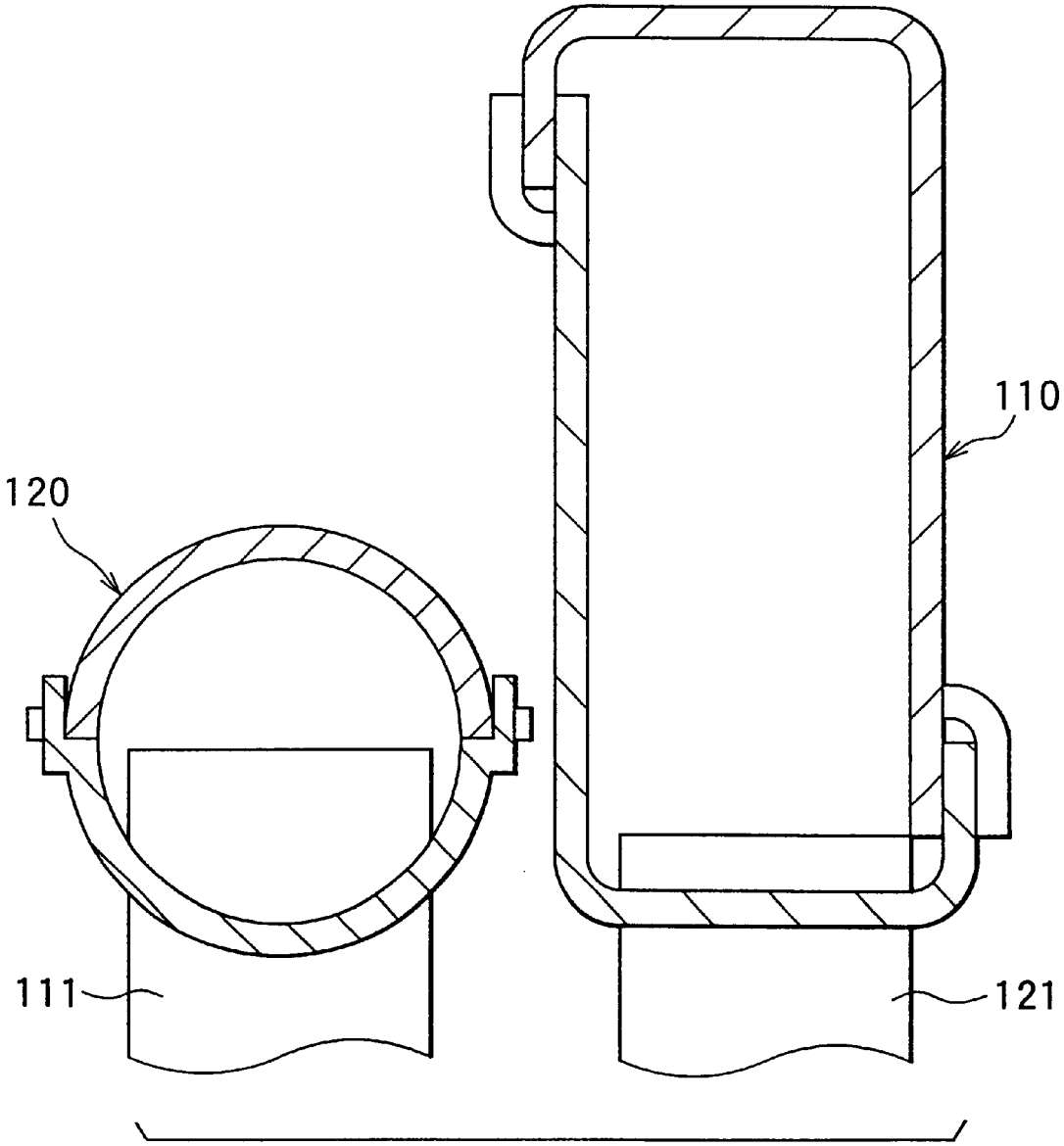
FIG. 9 is a sectional view showing a tank portion of a double heat exchanger according to a modification of the first embodiment.

As shown in FIG. 5, the protrusion 123*c* may contact the radiator tank cap 223 instead of the radiator tank 220 to form the gap δ between the condenser and radiator tanks 120, 220. Further, as shown in FIGS. 6 and 7, the protrusion 123*c* may not clamp the condenser cap 123 to the condenser tank 120. Moreover, as shown in FIG. 8, a protruding end of the protrusion 123*c* may be enlarged. Also, the condenser tank cap 223 may have a protrusion which contacts an outer wall of the condenser tank 220 or the condenser tank cap 123 to form the gap δ between the condenser and radiator tanks 120, 220. Further, as shown in FIG. 9, the condenser tank 120 may be formed by integrally brazing two tank members each of which is formed by pressing, similarly to the radiator tank 220. Further, the present invention may be applied to a multiple heat exchanger having three or more heat-exchange core portions.

Although the present invention has been fully described in connection with a preferred embodiment thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger through which air passes, the heat exchanger comprising:

a first core portion having a plurality of first tubes through which a first fluid flows and performing a heat exchange between the first fluid and the air;

a second core portion arranged in line with the first core portion in an air-flow direction in which the air flows, the second core portion having a plurality of second tubes through which a second fluid flows and performing a heat exchange between the second fluid and the air;

a first tank disposed at a flow-path end of the first tubes to extend in a direction perpendicular to a longitudinal direction of the first tubes and to communicate with the first tubes;

a second tank disposed at a flow-path end of the second tubes to extend in a direction perpendicular to a longitudinal direction of the second tubes and to communicate with the second tubes; and a first tank cap for closing an open end of the first tank in the direction perpendicular to the longitudinal direction of the first tubes, the first tank cap having a protrusion protruding from the first tank cap toward the second tank and contacting the second tank to form a gap between the first tank and the second tank.

2. The heat exchanger according to claim 1, wherein the first tank is brazed to the first tubes and the second tank is brazed to the second tubes.

3. The heat exchanger according to claim 1, further comprising a second tank cap for closing an open end of the second tank in the direction perpendicular to the longitudinal direction of the second tubes.

4. The heat exchanger according to claim 1, wherein the first tank cap is clamped to the first tank by the protrusion.

5. The heat exchanger according to claim 4, wherein a protruding end of the protrusion is enlarged.

6. The heat exchanger according to claim 1, wherein the protrusion is brazed to the second tank.

7. The heat exchanger according to claim 1, wherein the first tank and the second tank are separated from each other except the protrusion.

8. A heat exchanger through which air passes, the heat exchanger comprising:

a first core portion having a plurality of first tubes through which a first fluid flows and performing a heat exchange between the first fluid and the air;

a second core portion arranged in line with the first core portion in an air-flow direction in which the air flows, the second core portion having a plurality of second tubes through which a second fluid flows and performing a heat exchange between the second fluid and the air;

a first tank disposed at a flow-path end of the first tubes to extend in a direction perpendicular to a longitudinal direction of the first tubes and to communicate with the first tubes;

a second tank disposed at a flow-path end of the second tubes to extend in a direction perpendicular to a longitudinal direction of the second tubes and to communicate with the second tubes;

a first tank cap for closing an open end of the first tank in the direction perpendicular to the longitudinal direction of the first tubes;

a second tank cap for closing an open end of the second tank in the direction perpendicular to the longitudinal direction of the second tubes, wherein:

the first tank cap has a protrusion protruding from the first tank cap toward the second tank and contacting the second tank cap to form a gap between the first tank and the second tank.

* * * * *

UNITED STATES PATENT AND TRADEMARK OFFICE

CERTIFICATE OF CORRECTION

PATENT NO. : 6,267,174 B1
DATED : July 31, 2001
INVENTOR(S) : Tatsuo Ozaki et al.

It is certified that error appears in the above-identified patent and that said Letters Patent is hereby corrected as shown below:

Title page,
Item [30], Foreign Application Priority Data "(JP) 12-054426" should be -- (JP) 2000-054426 --

Signed and Sealed this

Twenty-sixth Day of March, 2002

*Attest:*

*Attesting Officer*

JAMES E. ROGAN
*Director of the United States Patent and Trademark Office*